United States Patent [19]

Hovey et al.

[11] 4,042,857

[45] Aug. 16, 1977

[54] CATHODE RAY TUBE CONVERGENCE SYSTEM

[75] Inventors: Frederick A. Hovey; Charles E. Torsch, both of Geneva, N.Y.

[73] Assignee: GTE Sylvania Incorporated, Stamford, Conn.

[21] Appl. No.: 680,091

[22] Filed: Apr. 26, 1976

[51] Int. Cl.[2] ..... H01J 29/70; H01J 29/76

[52] U.S. Cl. ..... 315/368; 315/13 C; 335/213

[58] Field of Search ..... 315/13 C, 368; 335/210, 335/213

[56] References Cited

U.S. PATENT DOCUMENTS 3,975,766 8/1976 Sano et al. ..... 315/368

*Primary Examiner*—Maynard R. Wilbur
*Assistant Examiner*—T. M. Blum
*Attorney, Agent, or Firm*—Norman J. O'Malley; Thomas H. Buffton; Robert T. Orner

[57] ABSTRACT

A cathode ray tube convergence system includes a cathode ray tube with a plurality of electron beam sources formed to provide electron beams which are underconverged inside of and converged outside of the screen of the tube and a deflection yoke associated with the cathode ray tube and having horizontal deflection windings effecting convergence at the outer ends of the horizontal axis of the cathode ray tube screen.

6 Claims, 8 Drawing Figures

CATHODE RAY TUBE CONVERGENCE SYSTEM

BACKGROUND OF THE INVENTION

This invention relates to a cathode ray tube convergence system for a television receiver wherein a cathode ray tube has a plurality of electron beam sources formed to effect underconvergence within and convergence of electron beams exterior to the cathode ray tube and a toroid-would deflection yoke affixed to the cathode ray tube with horizontal and vertical deflection windings for effecting deflection of the electron beams with the horizontal deflection windings providing converged electron beams at the outer ends of a horizontal axis of the cathode ray tube screen.

In prior known television receivers it has been a common practice to construct a cathode ray tube such that the electron beams are statically converged at the center of the viewing screen of the cathode ray tube. To achieve convergence at the outer ends of the horizontal and vertical axes as well as at the corners of the viewing screen, a deflection yoke and an electro-magnetic convergence means associated with the cathode ray tube are energized by potentials having a proper waveform. Thereupon, the statically converged electron beams available at the center of the viewing screen are not only deflected both horizontally and vertically but also dynamically converged at the extremities of the deflection.

Athough the above-mentioned electron beam convergence system has been and still is employed in numerous forms of television receivers, it has been found that it leaves something to be desired. Specifically, it has been found that such systems require large amounts of driving power in order to effect the desired corrections. Moreover, alteration in convergence at one side of the viewing screen usually affects the convergence on the opposite side of the viewing screen. Thus, a multitude of adjustments are necessary in order to achieve the desired uniformity of electron beam convergence.

One kmown effort to improve the above-described conditions is set forth in U.S. Pat. No. 3,849,679 issued to Marvin E. Miller on Nov. 19, 1974. Therein, a triad of electron beams is statically converged at the beginning and ending of the horizontal and vertical scan lines. Dynamic convergence apparatus is employed for effecting convergence of the electron beams at the center of the viewing screen. Thus, a plurality of magnets are employed to alter the electron beams derived from the cathodes of a cathode ray tube in a manner such that the beams are statically converged at the ends or periphery of the cathode ray tube screen. Moreover, dynamic correction potentials are applied to a dynamic converger apparatus to effect the desired center correction.

In another known effort to improve convergence in a cathode ray tube system, the cathode ray tube employs a plurality of electron beam sources aligned in a single plane. These electron beam sources are either aligned in a manner such that the electron beams are directed in parallel toward the viewing screen or in a divergent manner by a pair of outer guns directed in a divergent manner. A series of quadrupole windings are included on a deflection yoke associated with the cathode ray tube and these quadrupole windings serve to effect convergence of the electron beams throughout the viewing screen. Moreover, a corrector is also employed to insure the desired convergence of the electron beam.

Although the above-described techniques appear to have provided improvements over prior well-known deflection systems, it is believed that each leaves something to be desired. Specifically, the use of magnetic fields to effect electron beam distortion and convergence of these beams at the outer ends of the cathode ray tube requires increased electron beam influence and increased power to overcome the distortion due to the magnetic fields. Also, an electron beam deflection system wherein the generated electron beams are either parallel or divergent requires considerable power consumption to effect both static and dynamic convergence of those electron beams. Further, employing a relatively large amount of energy in the quadrupole windings to effect convergence tends to produce an undesired poor resolution condition at the corners of the viewing screen.

OBJECTS AND SUMMARY OF THE INVENTION

An object of the present invention is to provide an enhanced convergence system for a television receiver. Another object of the invention is to provide an in-line cathode ray tube convergence system having improved resolution. Still another object of the invention is to provide an in-line cathode ray tube and deflection yoke convergence system wherein the deflection yoke includes quadrupole windings having power requirements of a reduced amount as compared with other known systems. A further object of the invention is the provision of an in-line cathode ray tube an deflection yoke convergence system which minimizes auxilary dynamic convergence apparatus.

These and other and further objects, advantages and capabilities are achieved in one aspect of the invention by cathode ray tube convergence system having a cathode ray tube with a plurality of electron beam sources formed to underconverge inside and converge outside of a viewing screen and an associated deflection yoke having horizontal deflection windings acting in combination with the cathode ray tube to effect convergence of electron beams from the electron beam sources at the ends of a horizontal axis of the cathode ray tube viewing screen.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
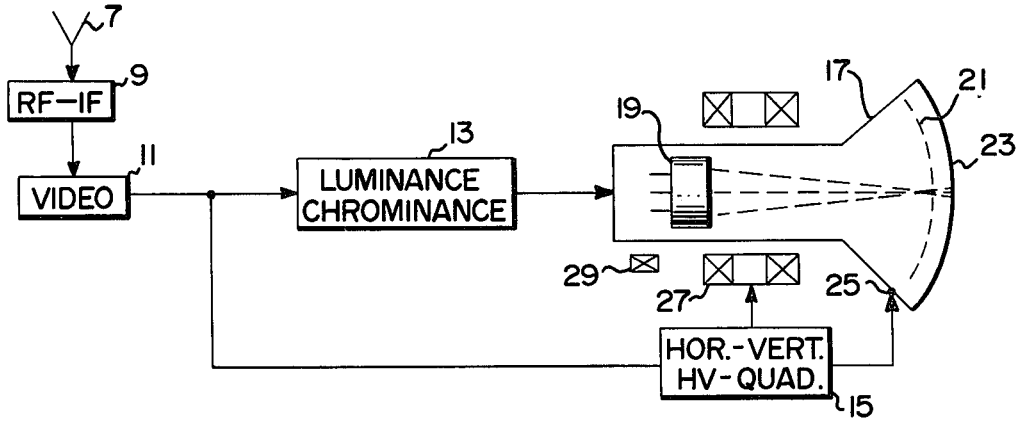
FIG. 1 is a schematic illustration of a color television receiver embodying the invention.

Referring to FIG. 1 of the drawings, a typical color television receiver includes an antenna 7 for intercepting transmitted color television signals. RF-IF amplifier and detector stages 9 are coupled to the antenna 7 and operate upon the received signals to provide an intermediate frequency output signal. This IF output signal is applied to a video signal channel 11 which provides one output to luminance and chrominance signal channels 13 and another output to horizontal, vertical, and quadrupole deflection and high voltage circuitry 15.

The signals from the luminance and chrominance signal channels are applied to a color cathode ray tube 17 having an electron beam source 19 which provides a plurality of electron beams R, G, and B aligned in a single plane. These electron beams are directed toward and pass through the apertures of a shadow mask 21 affixed in spaced relationship to a viewing screen 23. The viewing screen has horizontal and vertical axes with outer ends as well as corners. Moreover, triads of phosphor elements are affixed to the viewing screen and are responsive to electron beam impingement for providing a red, green, and blue color response.

Also, the high voltage and deflection circuitry 15 provides high voltage potentials which are coupled to a high voltage terminal 25 of the color cathode ray tube 17. The high voltage and deflection circuitry 15 also provides output potentials which are applied to a deflection yoke 27 associated with and affixed to the color cathode ray tube 17. The deflection yoke 27 includes horizontal, vertical, and quadrupole windings which act upon the electron beams to provide a pre-determined impingement of the phosphor elements by the electron beams. Moreover, a suitable static convergence assembly 29, adjustable magnets for example, is positioned adjacent the deflection yoke 27 and in association with the color cathode ray tube 17.

The above-described color television receiver is more or less typical of those in present use. Therein, the electron beam source 19 is constructed in a manner such that each of of the electron beams, R, G, and B is directed toward and converged at the center of the viewing screen 23. For example, one known 90° deflection angle cathode ray tube having a nineteen inch (19 inches) viewing screen had each of the outside electron beams, R and B, directed at an angle of about 1°40 inches with respect to the longitudinal axis of the cathode ray tube 17. Thus, the electron beams R, G, and B are normally angled to converge at the center of the viewing screen 23 and the convergence assembly is utilized to correct for small errors and variances in electron beam direction and insure a correct center convergence.

Figure 2A:
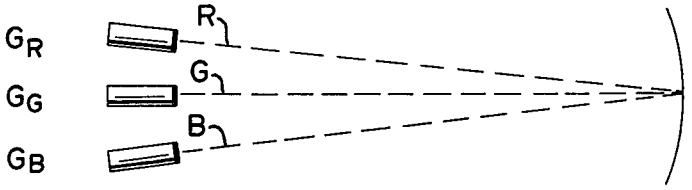
Fig. 2A PRIOR ART
FIGS. 2A and 2B are diagrammatic illustrations of prior art electron beam source and resultant convergence configuration.
Figure 2B:
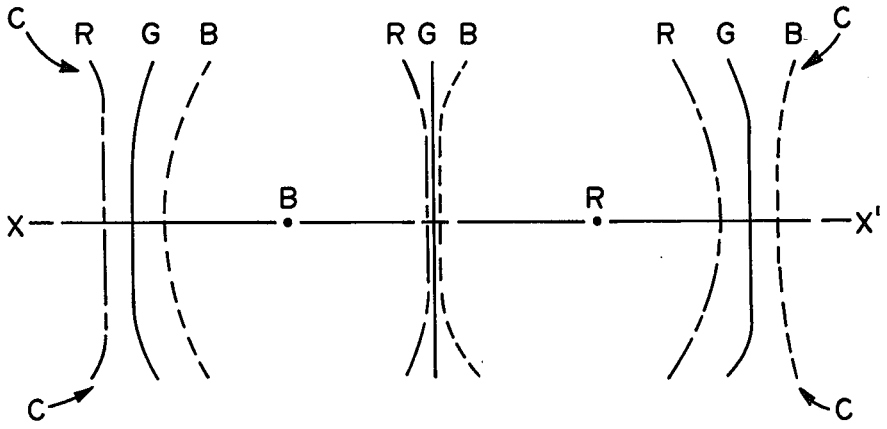
Fig. 2B PRIOR ART

As can be more clearly seen in FIGS. 2A and 2B, a widely accepted prior art cathode ray tube convergence systems employ a color cathode ray tube having red, green, and blue electron guns, $G_R$, $G_G$, $G_B$, aligned in a single horizontal plane. These electron guns $G_R$, $G_G$, $G_B$ are angled to provide electron beams R, G, and B which are directed to converge at the center of a viewing screen 23. Moreover, a deflection yoke and a static convergence assembly are utilized with the cathode ray tube to insure center, convergence of the electron beams R, G, and B.

Referring to FIG. 2B, center convergence of the electron beams R, G, and B is achieved with the above-described apparatus but it can readily be seen that there is a resultant relatively large amount of misconvergence at the ends of a horizontal axis X–X'. Also, the electron beams R, G, and B have a large amount of undesired misconvergence at the corners C of the viewing screen when this prior art type structure is employed.

Although the above-described large amount of misconvergence at the outer ends of the horizontal axis X–X' and at the corners C was correctable and convergence could be achieved by energizing the quadrupole winding associated with a deflection yoke, it was also found that there were other undesirable results. More specifically, it was found that a relatively large amount of energy was needed by the quadrupole windings to effect the desired convergence correction at the outer ends X–X' and the corners C. Morever, when such large amounts of energy were supplied to the quadrupole windings, the desired convergence was achieved but the resolution of the resultant converged electron beams was deleteriously affected. In other words, the introduction of large amounts of energy into the quadrupole windings provides the desired convergence correction but also degrades resolution to the point of marginal acceptance.

Figure 3A:
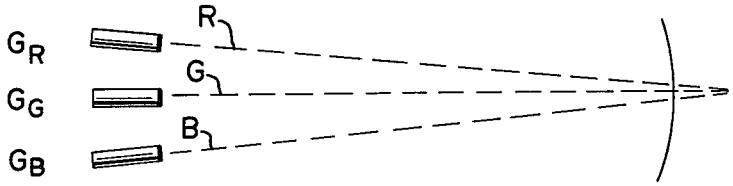
FIGS. 3A and 3B illustrate diagrammatically the electron beam source configuration and resultant convergence appearing on the viewing screen of the cathode ray tube of the present invention.
Figure 3B:
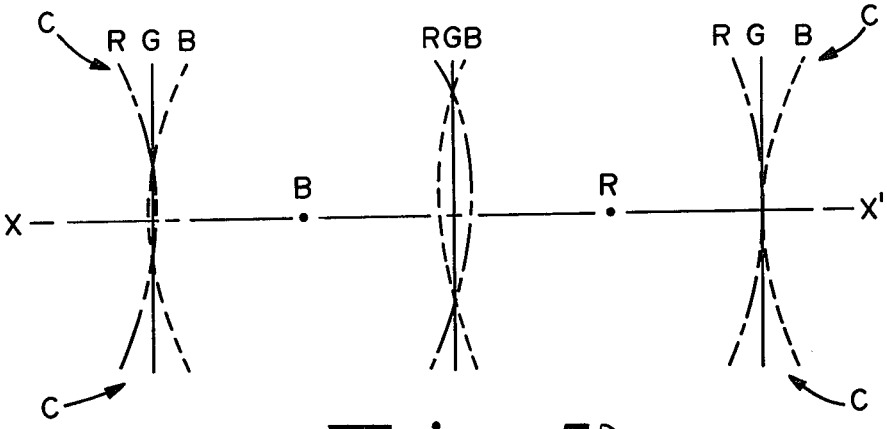

Referring to FIGS. 3A and 3B, a preferred technique for correcting the above-described undesirable results is effected by the provision of a convergence system which includes a cathode ray tube having electron guns or electron beam sources, $G_R$, $G_G$, and $G_B$, aligned in a horizontal plane and directed in a manner such that the electron beams R, G, and B are directed to underconverge at the center of the viewing screen and converge at a point outside of the viewing screen. In other words, the electron beams R, G, and B are directed at an angle intermediate a parallel condition and a condition of convergence at the center of a viewing screen.

Specifically, it has been found that the cathode ray tube is constructed such that the outer electron guns $G_R$ and $G_B$ are directed in a manner whereby the red and green electron beams are under converged at the center of the viewing screen and converged outside the viewing screen. For example, in one particular embodiment, a nineteen inch (19 inches) in-line color cathode ray tube having a 90° deflection angle was constructed such that the red and blue electron beams R and B were directed at an angle of about 1° inwardly with respect to the longitudinal axis of the cathode ray tube. Thus, the outer electron beams should be directed at an angle intermediate a parallel condition and a condition of convergence at the center of a viewing screen. Moreover, the angel will obviously vary with the size of the cathode ray tube i.e. as the tube size increses the angle correspondingly decreases.

Also, it was found that correction of the undesirable resolution problems required a convergence system which includes a special deflection yoke suitable for utilization with the above-described cathode ray tube. In this instance, a toroidwound deflection yoke was provided wherein the horizontal deflection windings are selectively positioned such that convergence of the electron beams, R, G, and B is achieved at the outer ends X–X' of the horizontal axis (FIG. 3B). Also, the horizontal windings are selectively positioned such that the misconvergence occuring at the corners C is greatly reduced as compared with prior known techniques. Moreover, the electron beams R, G, and B are misconverged at the center of the viewing screen with a tendency to converge at a point intermediate the center and outer ends of a vertical axis.

In this particular embodiment, correction of the above-described misconvergence of the electron beams R, G, and B is effected by energization of quadrupole windings disposed on the toroid-wound deflection yoke. It should be noted that a considerable reduction in energy applied to the quadrupole windings to effect the desired convergence is possible since the misconvergence to be corrected has been reduced considerably by the above-described cathode ray tube and deflection yoke. Also, it has been found that this reduced requirement for quadrupole winding energization results in a great improvement in resolution. Moreover, it should also be noted that the particular misconvergence configuration wherein the misconvergence at the center and in the corners of the viewing screen requiring movement of the electron beams in opposite directions permits the utilization of opposite phase potentials for energizing the quadrupole windings to achieve the desired convergence correction.

Figure 4A:
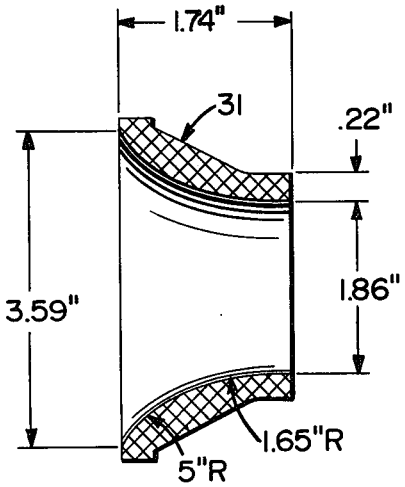
FIGS. 4A, 4B, and 4C illustrate a preferred core member form and horizontal, vertical, and quadrupole windings for toroid-winding on the core member.
Figure 4B:
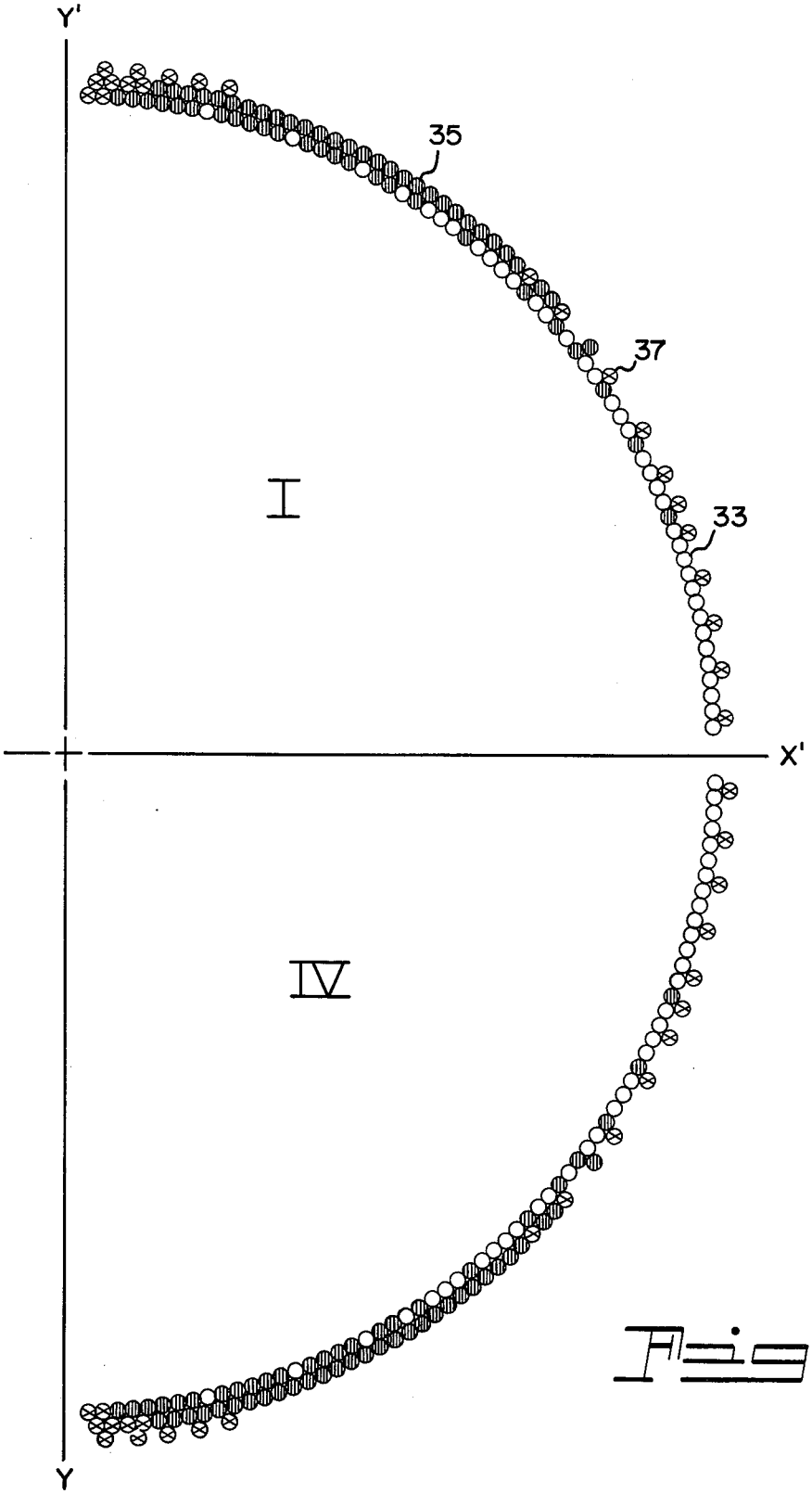
Figure 4C:
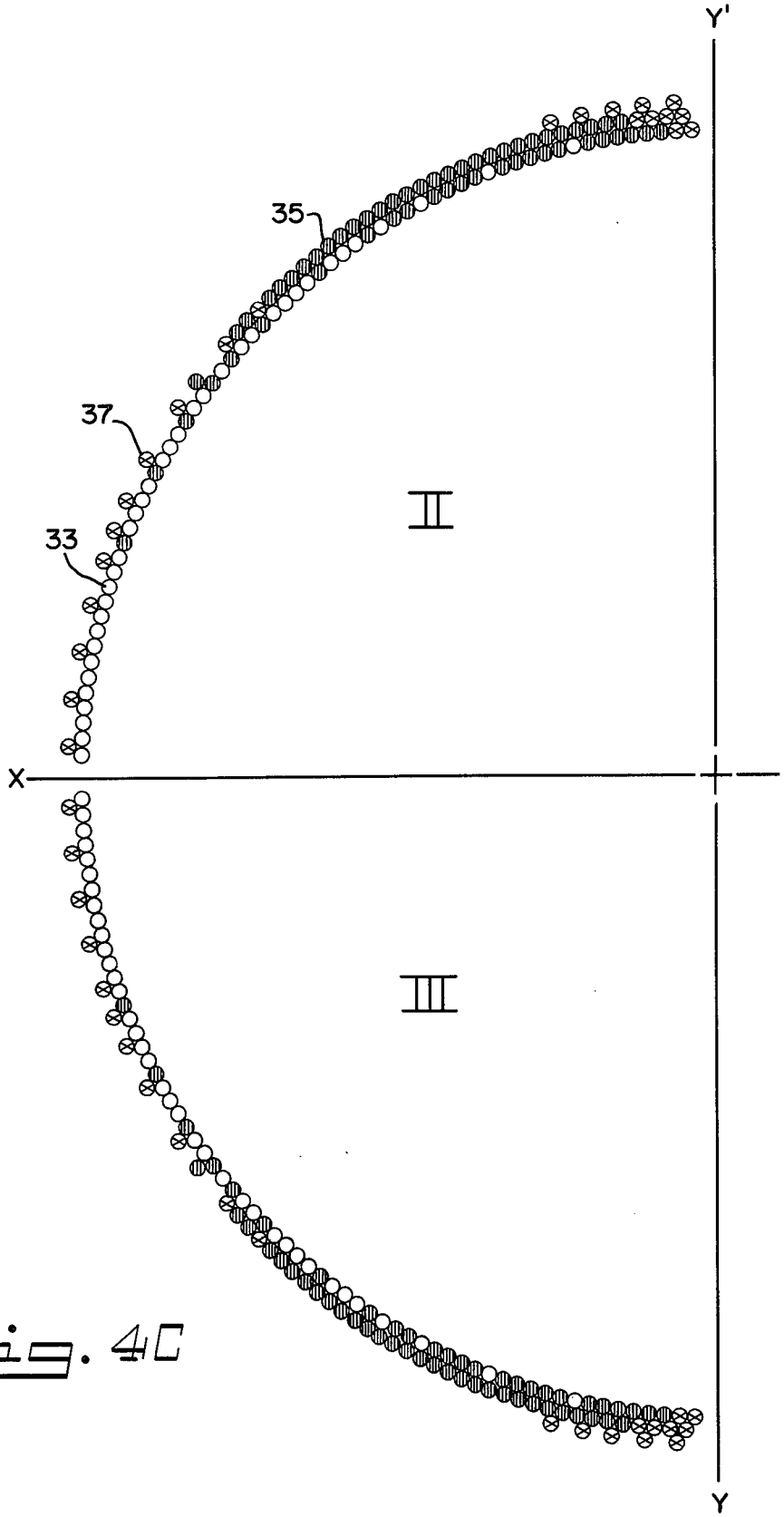

FIGS. 4A, 4B and 4C illustrate a preferred form of core member and toroid-wound deflection yoke windings suitable for utilization in the above-described cathode ray tube convergence system. The core member 31 of FIG. 4A is suitable for use with a 90° deflection angle cathode ray tube having a neck portion of a diameter of about 36 mm. This core member 31 has a length of about 1.74 inch with an inner diameter of about 1.86 inches at one end and about 3.59 inches at the opposite end. Moreover, the core member 31 is of a magnetic material with a thickness in the range of about 0.4 to 0.5 inches and of a form having a contour to provide an intimate relationship with the cathode ray tube.

The deflection yoke, windings FIGS. 4B and 4C have a horizontal axis X–X′ and a vertical axis Y–Y′ and are divided into four quadrants I, II, III, and IV bounded by the horizontal and vertical axes X–X′ and Y–Y′. A horizontal deflection winding 33, a vertical deflection winding 35, and quadrupole windings 37 are wound on the core member 31. Each of the horizontal, vertical, and quadrupole windings 33, 35, and 37 are selectively distributed to cooperate with the cathode ray tube and provide convergence of the electron beams as previously described. Moreover, the horizontal deflection winding 33, in this preferred embodiment, has a winding distribution which is substantially a mirror image on opposite sides of the vertical axis.

Additionally, the above-described preferred embodiment is directed to an in-line color cathode ray tube and toroid-wound deflection yoke having quadrupole windings. However, it should be noted that other combinations of cathode ray tube and deflection yokes are also possible. For example, a triad type cathode ray tube having electron beam sources formed to underconverge inside and converge outside the viewing screen in conjunction with a saddle-type deflection yoke formed to provide convergence at the outer ends of the horizontal axis are also appropriate to the present cathode ray tube convergence system. Moreover, combinations which include a convergence assembly in conjunction with the preferred cathode ray tube and deflection yoke to provide minimum correction for gun alignment variations are also appropriate.

Thus, there has been provided a unique cathode ray tube convergence system suitabe for use in a television receiver. The system includes a cathode ray tube wherein electron beams are directed to underconverge at the viewing screen and converge outside the viewing screen. A deflection yoke employed in conjunction with the cathode ray tube has windings selected to provide convergence of the electron beams at the outer ends of the horizontal axis of the viewing screen. Moreover, the resultant convergence errors are such that a reduced amount of energization is sufficient to effect the desired convergence and this reduced energization results in the desired improved resolution as observed on the viewing screen of the cathode ray tube.

While there has been shown and described what is at present considered the preferred embodiment of the invention, it will be obvious to those skilled in the art that various changes and modifications may be made therein without departing from the invention as defined by the appended claims.

What is claimed is:

1. A cathode ray tube convergence system comprising:

a color cathode ray tube having a viewing screen and a plurality of electron beam sources, said viewing screen having corners and a horizontal axis with a center and outer ends and said electron beam sources formed to provide electron beam underconvergence interior of and convergence exterior to the center of the horizontal axis of said viewing screen; and a deflection yoke affixed to said color cathode ray tube and including horizontal, vertical, and quadrupole windings on a core of magnetic material, said horizontal winding having a distribution selected to respond to energization to effect convergence of said electron beams from said electron beam sources at said outer ends of said horizontal axis of said viewing screen and said quadrupole windings having a distribution selected to respond to energization to effect convergence of said electron beams at said corners and said center of said horizontal axis of said viewing screen.

2. The cathode ray tube convergence system of claim 1 wherein said electron beam sources provide electron beams directed at an angle intermediate a parallel condition and a condition of convergence of said electron beam at the center of said viewing screen.

3. The cathode ray tube convergence system of claim 1 wherein said plurality of electron beam sources are aligned in a single plane.

4. The cathode ray tube convergence system of claim 1 wherein said horizontal, vertical, and quadrupole windings are toroidally affixed to said core of magnetic material.

5. In a color television receiver, a cathode ray tube convergence system comprising:

a color cathode ray tube having a viewing screen with corners and a horizontal axis having a center and outer ends and a plurality of electron beam sources aligned in a common plane and formed to provide electron beams underconverged inside and converged outside the center of said viewing screen; and a deflection yoke affixed to said color cathode ray tube, said deflection yoke having a core member of magnetic material and horizontal, vertical, and quadrupole windings toroid-wound on said core member with said horizontal winding having a distribution responsive to energization to effect deflection and convergence of said electron beams at said outer ends of said horizontal axis and quadrupole windings having a distribution responsive to energization to effect convergence of said electron beam at said corners and center of said viewing screen whereby energy required to effect corner convergence of said electron beams underconvergeed at said viewing screen center is reduced in comparison with the energy required to effect corner convergence of electron beams converged at said viewing screen center.

6. The cathode ray tube convergence system of claim 5 wherein said plurality of electron beam sources aligned in a common plane includes a center member and a pair of outer members with said pair of outer members directed at an angle intermediate a parallel condition with said center member and a condition of electron beam convergence at said center of said viewing screen.

* * * * *

UNITED STATES PATENT AND TRADEMARK OFFICE

CERTIFICATE OF CORRECTION

PATENT NO. : 4,042,857
DATED : August 16, 1977
INVENTOR(S) : Frederick A. Hovey and Charles E. Torsch It is certified that error appears in the above-identified patent and that said Letters Patent are hereby corrected as shown below:

| | |
|---|---|
| Col. 1, line 10 | Please delete "toroid-would" and insert -- toroid-wound --. |
| Col. 1, line 41 | Please delete "One kmown" and insert -- One known --. |
| Col. 2, line 31 | Please delete "an" (second instance) and insert -- and --. |
| Col. 2, line 33 | Please delete "auxilary" and insert -- auxiliary --. |
| Col. 4, line 47 | Please delete "angel" and insert -- angle --. |
| Col. 4, line 48 | Please delete "increses" and insert -- increases --. |

UNITED STATES PATENT AND TRADEMARK OFFICE

CERTIFICATE OF CORRECTION

PATENT NO. : 4,042,857
DATED : August 16, 1977
INVENTOR(S) : Frederick A. Hovey and Charles E. Torsch It is certified that error appears in the above-identified patent and that said Letters Patent are hereby corrected as shown below:

Col. 3, line 45 Please delete "inches" and insert -- minutes --.

Col. 3, line 52 Please delete "a".

Col. 5, line 27 Please delete "0.4 to 0.5" and insert -- 0.20 to 0.25 --.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*